US006659359B2

(12) United States Patent
Kwak

(10) Patent No.: US 6,659,359 B2
(45) Date of Patent: Dec. 9, 2003

(54) GRILLE CONTROLLING APPARATUS FOR INDOOR VENTILATOR

(76) Inventor: Young-Yeal Kwak, 101-405, Jang-mi Apt. 819-2, 3dong Hokye Dongan-gu, Anyang-si, 431-083 Kyungki-do (KR)

( * ) Notice: Subject to any disclaimer, the term of this patent is extended or adjusted under 35 U.S.C. 154(b) by 0 days.

(21) Appl. No.: 10/084,175

(22) Filed: Feb. 28, 2002

(65) Prior Publication Data

US 2003/0157883 A1 Aug. 21, 2003

(30) Foreign Application Priority Data

Feb. 19, 2002 (KR) ..... 2002/8853

(51) Int. Cl.[7] ..... F24F 11/053
(52) U.S. Cl. ..... 236/49.3; 454/258
(58) Field of Search ..... 454/256, 258, 454/322, 325, 326, 327; 236/1 B, 49.3

(56) References Cited

U.S. PATENT DOCUMENTS 302,215 A * 7/1884 Tucker ..... 236/49.3
369,801 A * 9/1887 Markland ..... 236/75
4,479,604 A * 10/1984 Didner ..... 236/49.3
4,646,964 A * 3/1987 Parker et al. ..... 236/49.3
5,449,112 A * 9/1995 Heitman et al. ..... 236/49.3
5,810,245 A * 9/1998 Heitman et al. ..... 236/49.3
5,833,134 A * 11/1998 Ho et al. ..... 236/49.3
6,364,211 B1 * 4/2002 Saleh ..... 236/49.3
2002/0058473 A1 * 5/2002 Park ..... 454/258

* cited by examiner

*Primary Examiner*—Harold Joyce
(74) *Attorney, Agent, or Firm*—Greenblum & Bernstein, P.L.C.

(57) ABSTRACT

Disclosed is a grille controlling apparatus for an indoor ventilator that senses an indoor temperature in a building such that it can control the operation of the grille mounted on the indoor ventilator. The apparatus includes a grill cover that is disposed on the front side of the indoor ventilator, a grille casing that is disposed on the rear side of the grille cover, at least one damper disposed on the rear side of the grille casing, for opening/closing an air flow path, a damper driving part for driving the damper up to an opening/closing position, a power supply part for supplying power to the damper driving part, a temperature sensor for sensing an indoor temperature, a manipulating part for selecting a predetermined driving mode of the damper driving part in accordance with the sensed indoor temperature of the temperature sensor, a control part for comparing a manipulating signal from the manipulating part and/or the selected driving mode with the sensed indoor temperature of the temperature sensor such that it controls the driving of the damper driving part, and an electronic circuit board provided with an operation display part on which the operation of the machinery is displayed. Thereby, the indoor temperature can be appropriately maintained at a pleasant temperature, thereby enabling an amount of energy to be consumed to be considerably saved.

18 Claims, 7 Drawing Sheets

GRILLE CONTROLLING APPARATUS FOR INDOOR VENTILATOR

BACKGROUND OF THE INVENTION

1. Field of the Invention

The present invention relates to a grille controlling apparatus that senses an indoor temperature in a building such that it can control the operation of the grille mounted on an indoor ventilator, and more particularly, to a grille controlling apparatus for an indoor ventilator that makes a conventional structure of the ventilator improved in such a manner as to automatically control the grille mounted on the ventilator.

2. Background of the Related Art

Generally, an indoor cell or wall in a building or house is provided with at least one ventilator that is connected to a duct in order to allow the flow of cool or hot air from/to external air or an air conditioner installed outside the building or house. The ventilator is provided with a grille apparatus that is adapted to allow or cut off the in-low of air inside the building or house.

A conventionally used grille apparatus is comprised of a grille casing that is provided with an air inflow path through which air flows indoors from the ventilator, and a damper of a blade shape that is disposed on the air inflow path of the grille casing in such a manner as to make the air inflow path opened/closed in a manually operating way.

In order to open/close the air inflow path, however, the damper should be operated by the direct manipulation of a user, such that it is inconvenient to use. More specifically, in case where a plurality of grille apparatuses are installed in a large building or house, such the inconvenience may be considerably increased.

In addition, the way of opening/closing the air inflow path by the manual manipulation of the damper is not sensitive to the variation of the indoor temperature, such that the indoor temperature cannot be constantly kept at an appropriate temperature.

Accordingly, the indoor temperature may be excessively up or down, which causes the air conditioner to be operated in an inefficient way, thereby producing the unnecessary consumption of energy.

SUMMARY OF THE INVENTION

Accordingly, the present invention is directed to a grille controlling apparatus for an indoor ventilator that substantially obviates one or more problems cue to limitations and disadvantages of the related art.

An object of the present invention is to provide a grille controlling apparatus for an indoor ventilator that is capable of making a damper opened/closed in an automatic manner by means of a remote controller, whereby it can be used in a convenient way and maintain an appropriate indoor temperature to thereby enable an amount of energy to be consumed to be saved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve this object and other advantages and in accordance with the purpose of the invention, as embodied and broadly described herein, there is provided a grille controlling apparatus for an indoor ventilator that has a grill cover disposed on the front side of the indoor ventilator and forming a plurality of grille holes on the plate surface thereof and a grille casing disposed on the rear side of the grille cover, the apparatus including: at least one damper disposed on the rear side of the grille casing, for opening/closing an air flow path; a damper driving part disposed on the one side of the grille casing, for driving the damper up to an opening/closing position; a power supply part for supplying power to the damper driving part; a temperature sensor for sensing an indoor temperature; a manipulating part for driving the damper driving part and/or for selecting a predetermined driving mode of the damper driving part in accordance with the sensed indoor temperature of the temperature sensor; a control part for comparing a manipulating signal from the manipulating part and/or the selected driving mode with the sensed indoor temperature of the temperature sensor such that it controls the driving of the damper driving part; and an electronic circuit board provided with an operation display part on which the operation of the machinery is displayed.

Desirably, the damper is formed by a pair of plate members that are turned on the upper and lower areas of the air flow path, and the damper driving part includes a driving motor disposed on the grille casing for opening/closing one of the pair of dampers, and an engaging part adapted to engage the pair of dampers.

At this time, the engaging part is provided with an engaging arm that has the both sides in a length direction rotatably coupled with the pair of dampers and a manually-operated protrusion that is extended from the one area of the engaging arm to the outside of the grille cover in such a manner as to manually manipulate the opening/closing of the damper.

Also, the damper is provided with a plate member that is disposed on the rear surface of the grille cover in such a way as to move back and forth between a position where the grille holes are closed and another position where the grille holes are opened, and a solenoid that is formed on the grille casing for moving the damper back and forth.

The manipulating part desirably includes a wireless remote controller with opening and closing buttons for the damper and with a plurality of mode selecting buttons for the driving modes, and a signal receiver disposed on the one area of the grille casing for sending the manipulating signal from the wireless remote controller to the control part.

If the manipulating signal for the opening or closing buttons from the manipulating part is received, on the other hand, the control part controls the driving of the damper driving part such that the damper is opened or closed.

The control part is provided with a plurality of appropriate indoor temperature ranges corresponding to the mode selecting buttons that are previously set, and it controls the opening/closing of the damper such that the indoor temperature sensed by the temperature sensor becomes in the appropriate indoor temperature range according to the mode selected by one of the mode selecting buttons.

It is to be understood that both the foregoing general descriotion and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings.

First Embodiment

Figure 1:
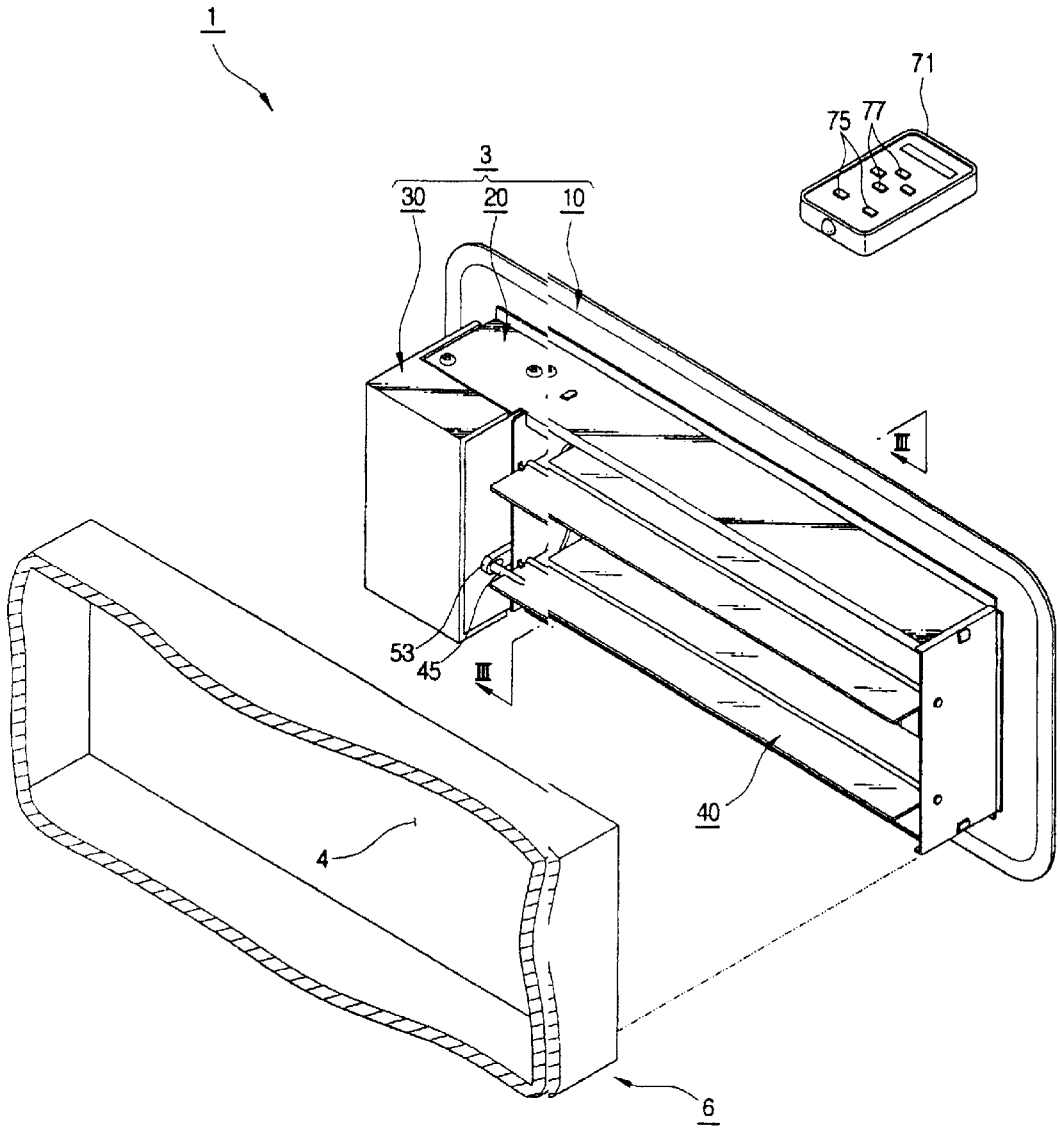
FIG. 1 is a rear perspective view of a grille controlling apparatus for an indoor ventilator according to a first embodiment of the present invention.
Figure 2:
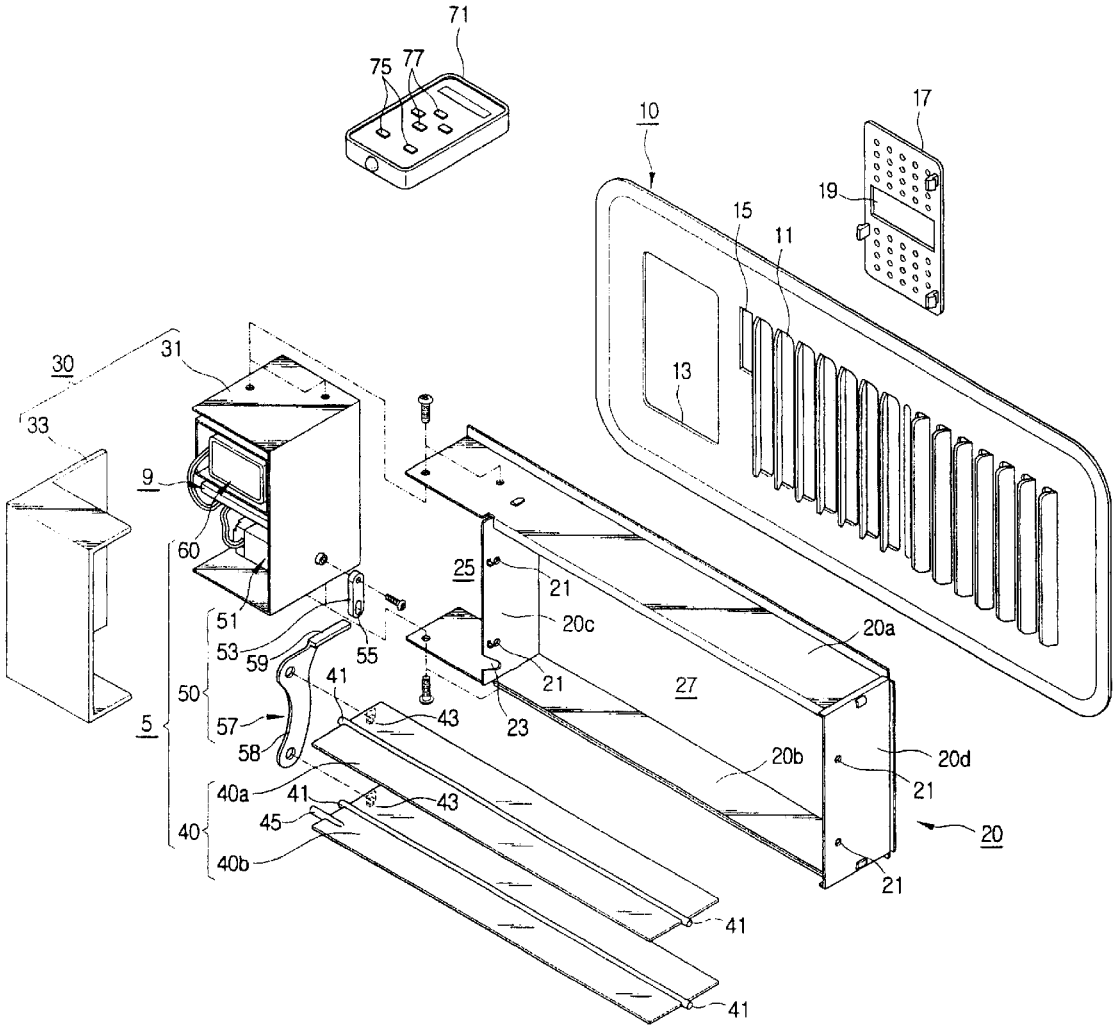
FIG. 2 is an exploded view of FIG. 1.
Figure 3:
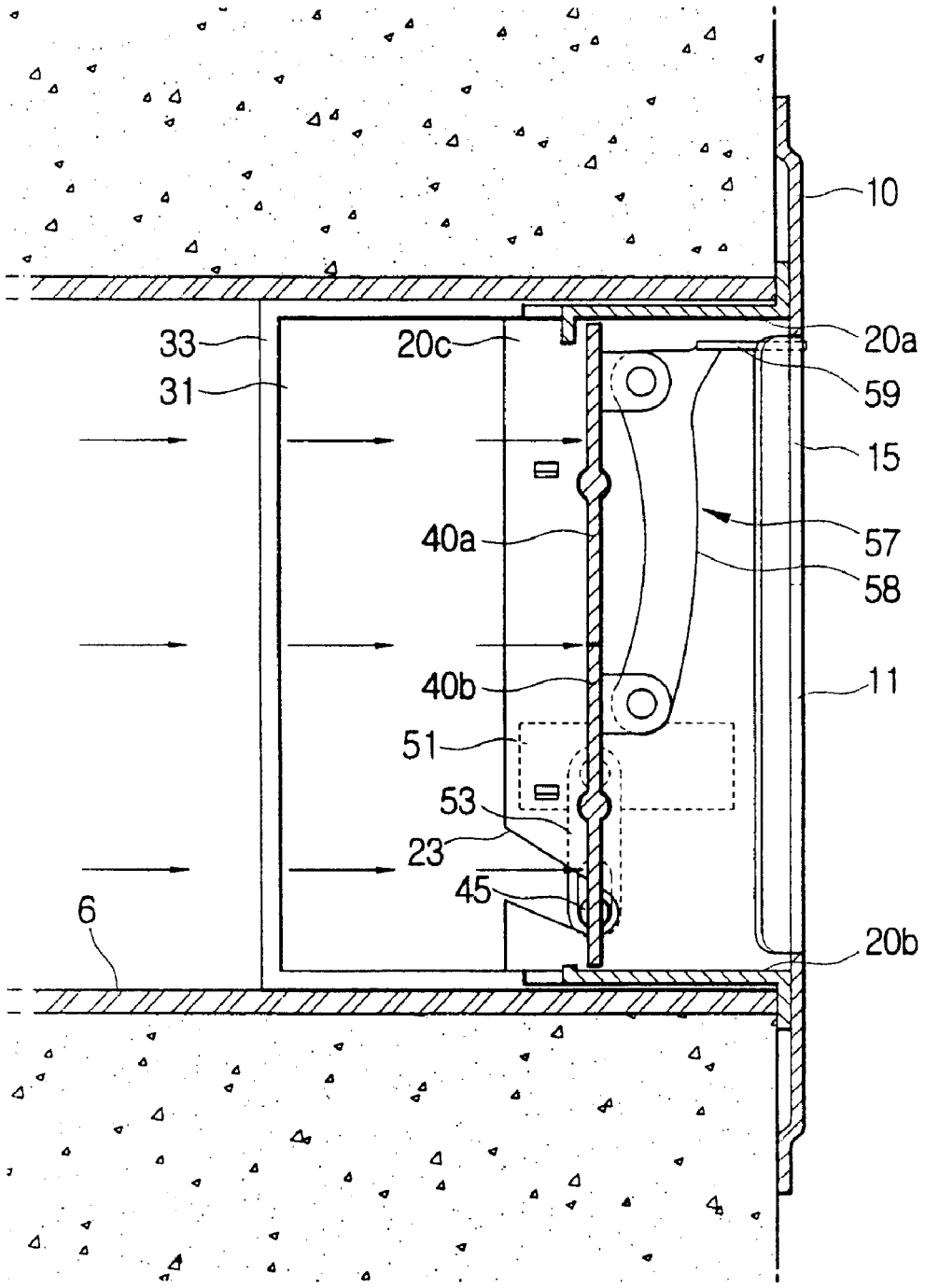
FIGS. 3 and 4 are sectional views taken along the line III—III in FIG. 1, wherein the opening and closing of the grille controlling apparatus are shown.
Figure 4:
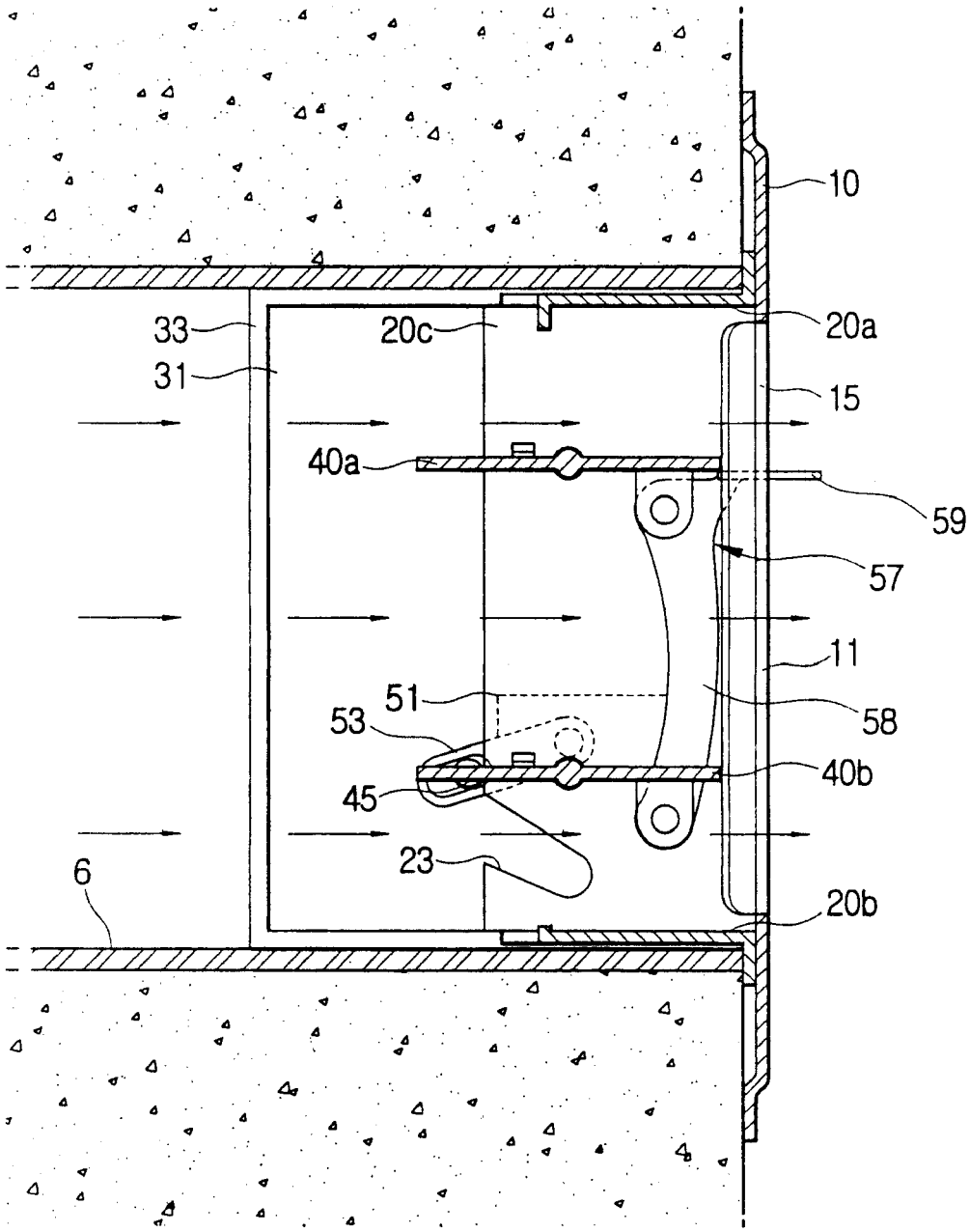

FIG. 1 is a rear perspective view of a grille controlling apparatus for an indoor ventilator according to a first embodiment of the present invention, FIG. 2 is an exploded view of FIG. 1, and FIGS. 3 and 4 are sectional views taken along the line III—III in FIG. 1, wherein the opening and closing of the grille controlling apparatus are shown. As shown in the figures, a grille controlling apparatus 1 according to the first embodiment of the present invention includes a casing 3 that is disposed on the front side of a ventilator 6, a damping unit 5 that is disposed in the casing 3 for opening/closing an air flow path 27, a temperature sensor 7 that is adapted to sense an indoor temperature, a manipulating part 70 that selects an arbitrary driving manipulation of the damping unit 5 and/or the driving mode of the damping unit 5, and an electronic circuit board 9 with a control part 80 controlling the driving of the damping unit 5 in accordance with the manipulating signal received from the manipulating part 70.

The casing 3 is provided with a grille cover 10 disposed for covering the front surface of the ventilator 4, a grille casing 20 coupled to the rear surface of the grille cover 10 in such a manner as to form the air flow path 27 and a parts-housing space 25, and a parts-housing bracket 30 coupled to the parts-housing space 25 of the grille casing 20.

The grille cover 10 is provided with a plurality of grille holes 11 and a parts-housing opening 13 on the plate surface thereof, and between the grille holes 11 and the parts-housing opening 13 is formed a longitudinal manually operated hole 15 through which a manually operated protrusion 59 of an engaging member as will be later discussed is exposed outside. At this time, the parts-housing opening 13 is closed by means of a cut-off plate 17 on which an exposed hole 19 is formed.

The grille casing 20 includes, upper and lower plates 20*a* and 20*b* that are coupled in a length direction with the upper and lower portions of the grille cover 10, and first and second side plates 20*c* and 20*d* that are coupled with the both sides of the upper and lower plates 20*a* and 20*b* in such a manner as to partition the parts-housing space 25 and the air flow path 27 with the upper and lower plates 20*a* and 20*b* (Hereinafter, the side plate, which is placed between the grille holes 11 of the grille cover 10 and the parts-housing opening 13, is called "the first side plate "20*c*"). The first and second side plates 20*c* and 20*d* form a shaft hole 21 through which a rotary shaft 41 of each of first and second dampers 40*a* and 40*b* as will be discussed later is inserted, on the upper and lower plate surfaces, respectively. And, the first side plate 20*c* is provided with a rotary groove 23 to and from which a driving shaft 45 of the second damper 40*b* is inserted and drawn during rotation.

The parts-housing bracket 30 includes a bracket 31 that forms the parts-housing space where a battery, a driving motor 51, an electronic circuit board 9, a temperature sensor 7, a signal receiver 73, and so on, as will be below discussed, are accommodated, and a bracket cover 33 for closing the rear and side parts of the bracket 31. In this case, the parts-housing bracket 30 is adapted to pre-assemble the battery, the driving motor 51, the electronic circuit board 9, the temperature sensor 7, the signal receiver 73, and so on such that they are simply accommodated in the parts-housing space 25. In some cases where the parts-housing bracket 30 is not separately provided, each part can be directly accommodated in the parts-housing space 25 of the grille casing 20.

The damping unit is comprised of a damper 40 that is rotatably disposed within the air flow path 27 of the grille casing 20, a damper driving part 50 that is disposed in the parts-housing bracket 30 for rotating the damper 40, and a power supply part 60 that supplies power to the damper driving part 50.

The damper 40 is formed by a pair of plate blades that are rotatably arranged on the upper and lower portions of the air slow path 27 of the grille casing 20 (For the convenience of an explanation, hereinafter, the upper damper is referred to as "the first damper 40*a*" and the lower damper "the second damper 40*b*"). To do this, on the centers of the both sides of each of the first and second dampers 40*a* and 40*b* is provided the rotary shaft 41 that is outwardly extruded in such a manner as to be inserted into each of the shaft holes 21 on the both sides of the grille casing 20. And, on the one side of each of the first and second dampers 40*a* and 40*b* is provided an engaging coupling projection 43 that is protruded horizontally against the plate of the first and second dampers 40*a* and 40*b* such that it can be coupled with an engaging member 57 as will be discussed later, and on the one side of the second damper 40*b* is provided the driving shaft 45 that is protruded in such a manner as to be coupled to an eccentric rotary arm 53 of the damper driving part 50 as will be discussed below.

The damper driving part 50 is provided with a driving motor 51 driven by the power supply, the eccentric rotary arm 53 for rotating the second damper 40*b* by the rotary force of the driving motor 51 to thereby open/close the second damper 40*b*, and the engaging member 57 for rotating the first and second dampers 40*a* and 40*b*, at the same time, to thereby open/close them.

The driving motor 51 includes a small-sized D/C motor capable of being rotated forwardly and backwardly and is disposed on the lower area of the parts-housing bracket 30. At this time, the rotary shaft of the driving motor 51 is protruded to the first side plate 20*c* of the grille casing 20.

The eccentric rotary arm 53 is fixed on the rotary shaft of the driving motor 51 on the one side thereof and is coupled to the driving shaft 45 of the second damper 40*b* on the other side thereof with a result that the second damper 40*b* is rotated to be opened and closed. At that time, the eccentric rotary arm 52 forms a longitudinal shaft insertion hole 55 through which the driving shaft 45 of the second damper 40*b* is inserted, on the other side in the length direction thereof.

The engaging member 57 is provided with an engaging arm 58 that has the both ends in a length direction rotatably coupled by means of a hinge with the engaging coupling projections 43 of the first and second dampers 40*a* and 40*b*, and a manually operated protrusion 59 that is extended from the engaging arm 58 in such a manner as to be exposed indoors through the manually operated hole 15 on the grille cover 10. In that case, the manually operated protrusion 59. acts to open/close the first and second dampers 40*a* and 40*b* in a manual manner, when the driving motor 51 does not work.

In that case, the damper 40 of the damping unit 5 is provided in plurality as described in the above embodiment of the present invention, but may be provided alone. At that time, the eccentric rotary arm 53 and the engaging member 57 do not need to be required, and therefore, the rotary shaft 41 of the damper 40 is directly coupled to the rotary shaft of the driving motor 51 such that the damping unit 5 is configured in a simple manner.

The power supply part 60 includes the battery mounted exchangeably in the one area of the parts-housing bracket 30. The battery is electrically connected to the electronic circuit board 9 and the driving motor 51 so as to supply the power to the driving motor 51 through the electronic circuit board 9. Instead of the battery, the power supply part 60 can use D/C power that is converted by general A/C power supplied in a building or house.

The temperature sensor 7 is disposed in the parts-housing bracket 30 for electrically coupling with the electronic circuit board 9. The temperature sensor 7 serves to sense the indoor temperature through the exposed hole 19 on the cut-off plate 17 and transmits the sensed indoor temperature value to the control part 80.

The manipulating part 70 includes a wireless remote controller 71 and a signal receiver 73 receiving the manipulating signal from the wireless remote controller 71. The wireless remote controller 71 is provided with opening and closing buttons 75 with which the opening and closing operations can be selected, and a plurality of mode select buttons 77 (for example, summer and winter modes) with which the driving modes (for example, summer and winter modes) that are preset in the control part 80 can be selected. The signal receiver 73 is disposed in the parts-housing bracket 30 of the casing 3 for electrically coupling with the electronic circuit board 9 and transmits the manipulating signal received from the wireless remote controller 71 to the control part 80.

In this case, the manipulating part 70 adopts a wire way where the wireless remote controller 71 is electrically connected to the electronic circuit board 9 by means of a signal transmitting cable, but it may adopt a manipulating panel way where it is disposed in such a manner as to be electrically connected on the one area of the grille cover 10 of the casing 3.

The electronic circuit board 9 is installed in the parts-housing bracket 30, thus to be electrically connected to the parts such as the driving motor 51, the battery, the temperature sensor 7 and the signal receiver 73. The electronic circuit board 9 includes the plurality of electronic parts, the control part 80 for controlling the opening/closing of the damper 40, and an operation display part 85 for displaying the operation of the machinery.

The control part 80 is comprised of a microcomputer 81 that is made of a semiconductor chip so as to be inserted into the electronic circuit board 9, and a plurality of control circuit parts. The control part 80 controls the driving of the driving motor 51 in accordance with the manipulating signal transmitted through the signal receiver 73 from the wireless remote controller 71 of the manipulating part 70, such that the damper 40 can be opened and closed. That is to say, according to the technical spirit of the present invention, if the mode select buttons 77 on the wireless remote controller 71 is depressed by a user, the control part 80 controls the driving of the driving motor 51 in accordance with the temperature ranges preset in the microcomputer 81, with a result that the damper 40 can be opened or closed.

In that way, the temperature ranges preset in the microcomputer 81 mean appropriate indoor temperature ranges. As an example, the appropriate indoor temperature range in summer is set between about 22° C. and 24° C., and that in winter is between about 24° C. and 26° C. The control part 80 compares the appropriate indoor temperature in summer or winter preset according to the select mode (summer mode or winter mode) selected among in the mode select buttons 77 with the sensed indoor temperature of the temperature sensor 7 such that it controls the driving of the damper motor 51 to thereby open/close the damper 40. As a consequence, the indoor temperature can be kept in the appropriate temperature range preset. For example, in case of the summer mode, cool air flows indoors from an external air conditioner (which is not shown in the drawing) or cuts off to the outside of the building or house. Contrarily, in case of the winter mode, hot air flows indoors or cuts off to the outside of the building or house, such that the indoor temperature can be kept at the appropriate temperature preset.

The operation display part 85 includes at least one Light emitting diode (LED) 87 that is electrically connected to the electronic circuit board 9. The LED 87 is exposed indoors through the exposed hole 19 of the cut-off hole 17 such that flickering can be checked by the user. Preferably, there is provided one or more LED 87 which display the states of the battery, driving motor 51 and the signal reception. At that time, the LEDs 87 have different kinds of colors in order to distinguish the operation states.

Figure 5:
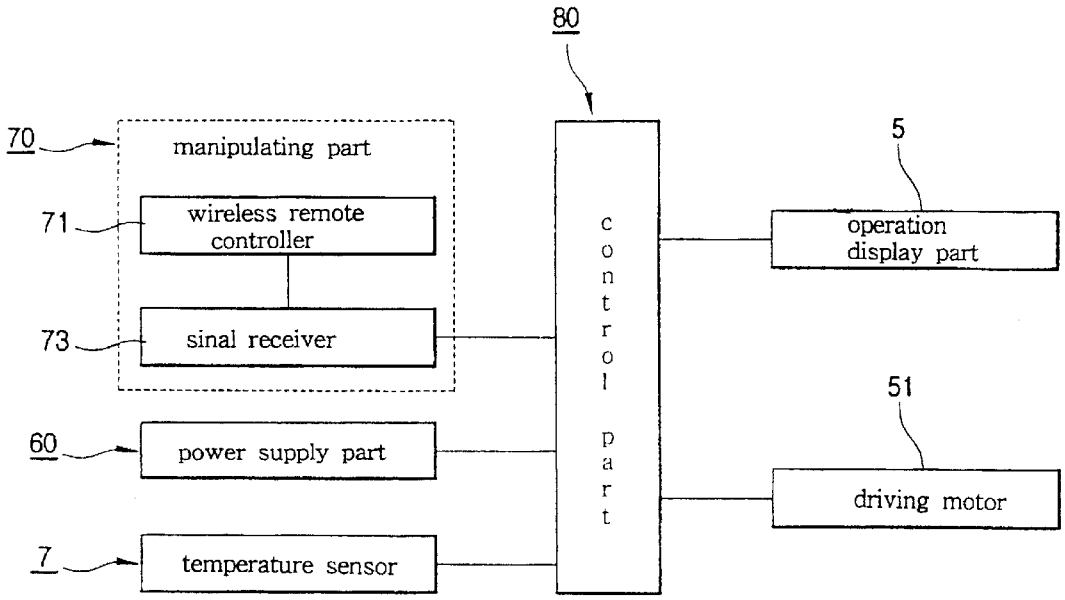
FIG. 5 is a block diagram of the grille controlling apparatus according to the present invention.
Figure 6:
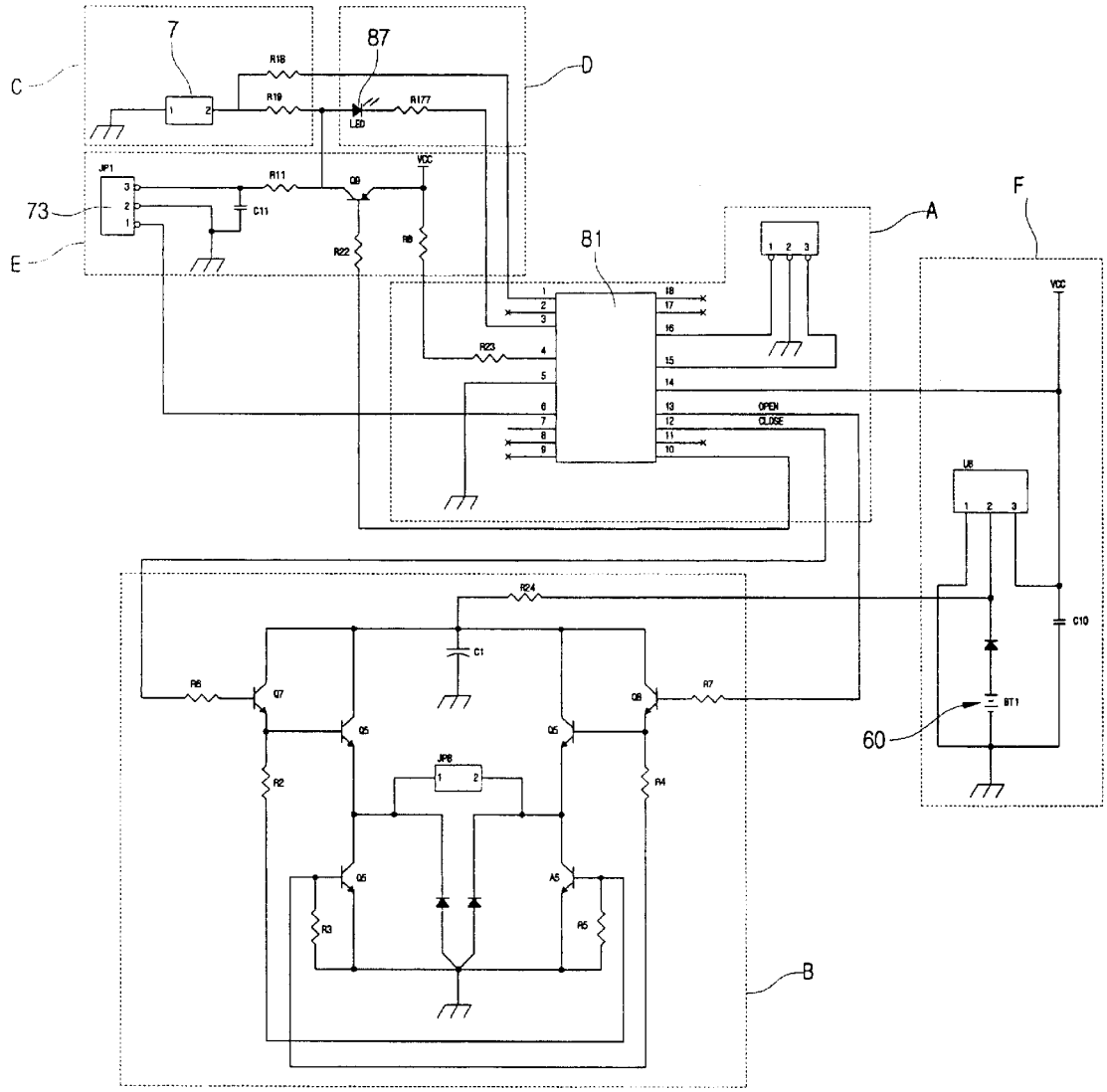
FIG. 6 is a circuit diagram of the grille controlling apparatus according to the present invention.

On the other hand, FIG. 5 is a block diagram of the grille controlling apparatus according to the present invention, and FIG. 6 is a circuit diagram of the grille controlling apparatus according to the present invention. As shown, if the manipulating buttons on the wireless remote controller are depressed in order to use the grille controlling apparatus 1 according to the present invention, the manipulating signal is transmitted to the control part 80 through the signal receiver 73. At that time, the control part 80 turns on the LED 87 as the operation display part 85 such that it displays whether the power supply state and the signal receiving state are all normal.

When the manipulating signal is transmitted to the control part 80, it is determined whether it is from the opening or closing button 75 or from the mode select button 77 by means of the control part 80. At this time, if it is determined that the manipulating signal is from the opening or closing button 75, the control part 80 drives the driving motor 51 such that the damper 40 rotates to be opened or closed, thereby enabling the air flow path to be opened and closed.

On the other hand, if it is determined that the manipulating signal is from the mode select button 77, the control part 80 compares the temperature range preset according to the select mode in the microcomputer 81 with the current indoor temperature and based upon the compared result, drives the driving motor 51 such that the damper 40 rotates to be opened or closed.

For example, in case where the select mode is the summer mode, the control part 80 checks as to whether the current indoor temperature in the temperature sensor 7 is in the appropriate indoor temperature range in the summer mode of about 22° C. and 24° C. If the current indoor temperature is under 22° C., it closes the damper 40, as shown in FIG. 3, such that the flow of the cool air to the inside from the air conditioner can be prevented, and contrarily, if the current indoor temperature is over 24° C., it opens the damper 40, as shown in FIG. 4, such that the flow of the cool air to the inside from the air conditioner can be allowed.

On the other hand, in case where the select mode is the winter mode, the control part 80 checks as to whether the current indoor temperature in the temperature sensor 7 is in the appropriate indoor temperature range in the winter mode of about 24° C. and 26° C. If the current indoor temperature is under 24° C., it opens the damper 40, as shown in FIG. 4, such that the flow of the hot air to the inside from the air conditioner can be allowed, and contrarily, if the current indoor temperature is over 26° C., it opens the damper 40, as shown in FIG. 3, such that the flow of the hot air to the inside from the air conditioner can be prevented.

Thereby, the indoor temperature can be constantly maintained at the preset appropriate temperature. Also, the damper 40 can be opened and closed in automatically operating manner, which enables the air conditioner to be effectively used and enables an amount of energy to be consumed to be considerably reduced.

Referring to FIG. 6, a portion 'A' represents the circuit configuration of the control part 80 controlling the control of machinery, 'B' the circuit configuration of the driving motor 51 driven by the microcomputer 81 of the control part 80, 'C' the circuit configuration of the temperature sensor 7, 'D' the circuit configuration of the LED 87 of the operation display part 85, 'E' the circuit configuration of the signal receiver 73 receiving the manipulating signal of the wireless remote controller 71, and 'F' the circuit configuration of the power supply unit 60.

Second Embodiment

Figure 7A:
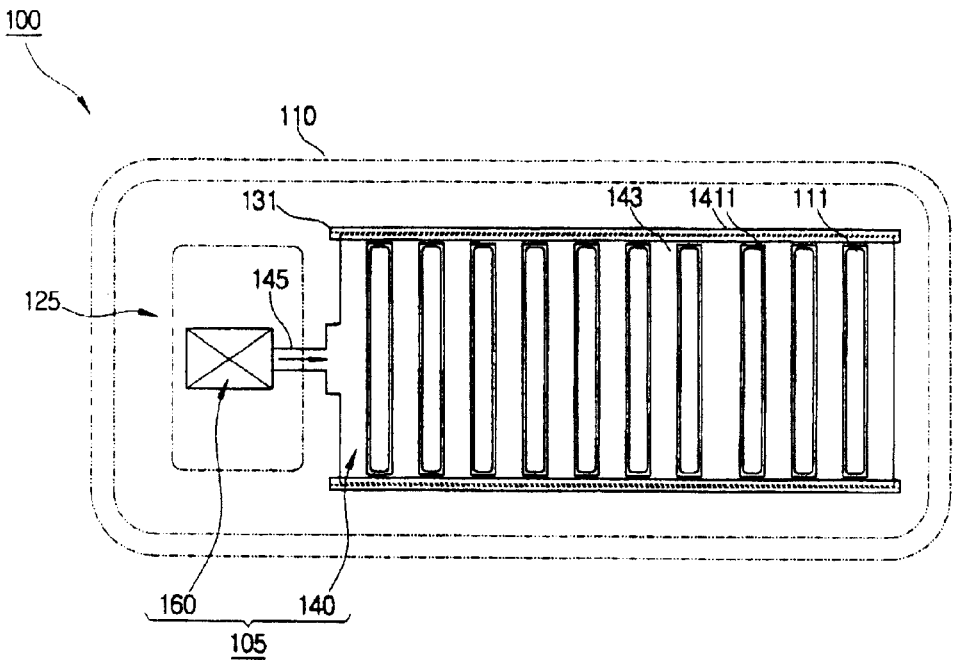
FIGS. 7A and 7B are front sectional views of a grille controlling apparatus for an indoor ventilator according to a second embodiment of the present invention.
Figure 7B:
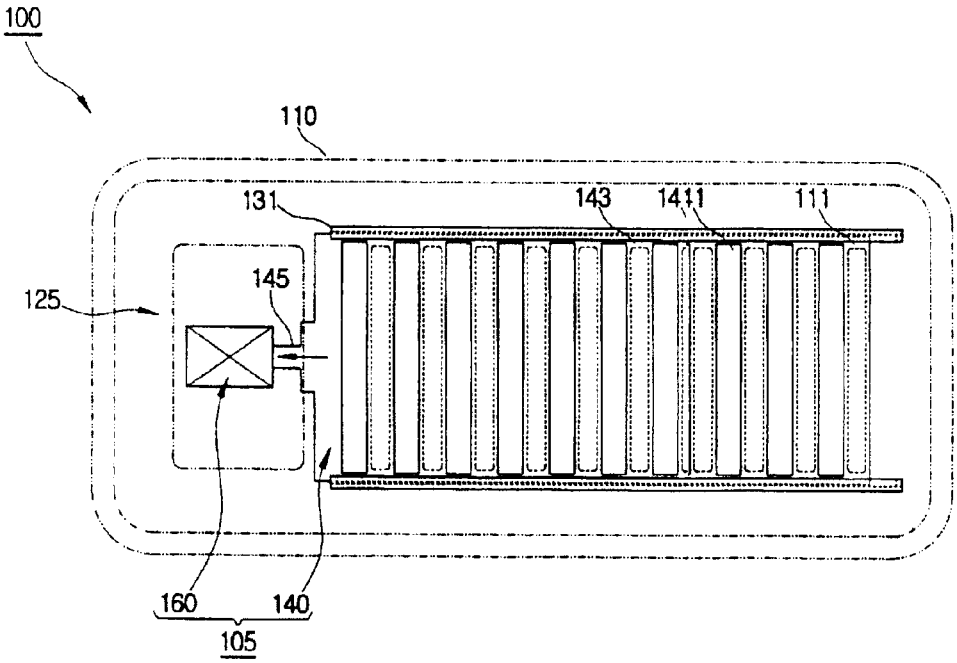

FIGS. 7A and 7B are front sectional views of a grille controlling apparatus for an indoor ventilator according to a second embodiment of the present invention. As shown, a damping unit 105 of the grille controlling apparatus 100 according to the second embodiment of the present invention is provided with a damper 140 that is slid and moved in a straight line direction on the rear surface of a grille cover 110. A damper driving part, which slides and moves the damper 140, is embodied with a solenoid 160.

The damper 140 is provided with a plurality of communicating holes 141 that correspond to a plurality of grille holes 111 of the grille cover 110, spaced at predetermined intervals. The plate surface of the damper 140 between the plurality of communicating holes 141 acts as a closing part 143 that closes the plurality of grille holes 111. The damper 140 is provided, on the one side toward a parts-housing space 125, with a plunger coupling part 145 that is coupled to a plunger (which is omitted in the drawing) of the solenoid 160. The damper 140 is moved backward and forward from an opening position where the grille holes 111 and the communicating holes 141 are met with each other to a closing position where the grille holes 111 and the closing part 143 are met with each other, by virtue of the driving force of the solenoid 160. At that time, on the upper and lower portions of the rear surface of the grille cover 110, respectively, is formed a guide 131 that supports the sliding movement of the damper 140.

The solenoid 160 as the damper driving part is supplied power from the battery like the driving motor in the first embodiment of the present invention and is electrically connected to an electronic circuit board which is not shown such that it can be controlled by the control part. With the power supplied, the solenoid 160 allows the plunger to be moved back and forth such that the damper 140 can be slid and moved.

The control way of the operation in the grille controlling apparatus 100 according to the second embodiment of the present invention is the same as in the grille controlling apparatus 1 as shown in FIGS. 1 to 6, except a fact that the structure the damping unit 105 has is different from that the damping unit 5 has. Therefore, an explanation of the operation of the grille controlling apparatus 100 according to the second embodiment of the present invention will be avoided for the brevity of description.

Hence, a grille controlling apparatus according to the preferred embodiments of the present invention is capable of opening and closing a damper by using a wireless remote controller, thus to make it convenient to use, and controlling the opening/closing of the damper in automatic manner such that an indoor temperature can be constantly maintained at a preset appropriate temperature, whereby it enables an air conditioner to be effectively used and enables an amount of energy to be consumed to be considerably saved.

As clearly understood from the foregoing, a grille controlling apparatus according to the preferred embodiments of the present invention is able to open and close a damper in an indoor ventilator in automatic manner, according to the variation of an indoor temperature in a building or house, whereby it is convenient to use. Additionally, the indoor temperature can be appropriately maintained at a pleasant temperature, thereby enabling an amount of energy to be consumed to be considerably saved.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A grille controlling apparatus for a ventilator having a grille cover on a front side of said ventilator and a grille casing on a rear side of said grille cover, the grille cover defining a plurality of grille holes, said apparatus comprising:

at least one damper configured to open and close an air flow path;

a damper driver, attached to said grille casing, that drives said damper to open and close the air flow path;

a power supply that supplies power to at least said damper driver;

a temperature sensor that senses an ambient temperature;

a manipulator that selects one of a manipulation command and a predetermined driving mode of said damper driver; and a controller that receives a manipulating signal from the manipulator indicating one of the manipulation command and the selected driving mode, compares one of the manipulating signal and the selected driving mode with the sensed temperature of said temperature sensor, and controls said damper driver based on the comparison.

2. The grille controlling apparatus according to claim 1, wherein said at least one damper comprises two plate members that are respectively positioned in an upper area and a lower area of said air flow path, and wherein said damper driver comprises a driving motor and an engaging part configured to engage said plates.

3. The grille controlling apparatus according to claim 2, wherein said engaging part further comprises a manual engaging arm, rotatably coupled with said pair of plates, and a manually operated protrusion extending from said engaging arm through said grille cover to enable manual manipulation of said damper.

4. The grille controlling apparatus according to claim 1, wherein said damper comprises a plate member that is disposed on the rear surface of said grille cover in such a way as to move back and forth between a position where said grille holes are closed and another position where said grille holes are opened and a solenoid that is formed on said grille casing for moving said damper back and forth.

5. The grille controlling apparatus according to claim 1, wherein said manipulator comprises a wireless remote controller, having at least an opening button, a closing button and a plurality of mode selecting buttons, and a signal receiver, connected to said controller, the signal receiver receiving the manipulating signal from said wireless remote controller and sending the received signal to said controller for controlling said damper driver.

6. The grille controlling apparatus according to claim 5, wherein said controller controls said damper driver to open and close said damper in accordance with the manipulating command respectively corresponding to the opening button and the closing button.

7. The grille controlling apparatus according to claim 5, wherein said controller is provided with a plurality of preset temperature ranges corresponding to the plurality of mode selecting buttons on said wireless remote controller, said controller opening and closing said damper in accordance with a selected one of said modes, selected by the mode selecting buttons, to match the temperature sensed by said temperature sensor with the temperature range corresponding to the selected mode.

8. The grille controlling apparatus according to claim 1, further comprising a display that displays at least one of the sensed temperature and the driving mode.

9. An apparatus for controlling air flow through a ventilator, comprising a casing and a grille cover connected to a front side of the casing, the grille cover defining a plurality of holes enabling air flow, the apparatus comprising:

a driver that drives a damper to open and close, respectively increasing and decreasing the air flow through the grille;

a manipulator that enables selection of one of a plurality of modes of the driver, each mode being associated with at least a predetermined temperature range; and a controller that receives an ambient temperature from a temperature sensor and a manipulating signal from the manipulator, the manipulating signal indicating the selected mode, the controller comparing the predetermined temperature range corresponding to the selected mode with the ambient temperature and controlling the driver to adjust the air flow based on the comparison.

10. The apparatus for controlling air flow through a ventilator according to claim 9, wherein the controller controls the driver to one of open and close the damper, when the ambient temperature is out of the predetermined range, in order to bring the ambient temperature into the predetermined range.

11. The apparatus for controlling air flow through a ventilator according to claim 9, wherein the controller is preprogrammed with the plurality of modes and the corresponding plurality of predetermined temperature ranges.

12. The apparatus for controlling air flow through a ventilator according to claim 9, the manipulator further enabling selection of a manipulation command, indicating one of opening and closing the damper, the controller driving the driver to one of open and close the damper, respectively, in accordance with the manipulation command.

13. The apparatus for controlling air flow through a ventilator according to claim 12, the damper comprising a plurality of parallel plate members, and the driver comprising a driving motor and an engaging part configured to engage the driving motor and the plurality of plate members.

14. The apparatus for controlling air flow according to claim 13, the engaging part further comprising a manually operated protrusion extending from the engaging part through the grille cover to enable manual operation of the plurality of plate members.

15. The apparatus for controlling air flow according to claim 12, the manipulator comprising:

a wireless remote controller, having a plurality of manipulating command inputs and a plurality of mode selecting inputs; and a signal receiver, connected to the controller, that receives one of a manipulating command and a mode selection from the wireless remote controller, the controller receiving the one of the manipulating command and the mode selection from the signal receiver for controlling the driver.

16. The apparatus for controlling air flow according to claim 15, the plurality of manipulating command inputs comprising an opening button and a closing button, wherein the controller controls the driver to open and close the damper in accordance with selection of the opening button and the closing button, respectively.

17. The apparatus for controlling air flow according to claim 15, the plurality of mode selection inputs comprising a plurality of mode selection buttons, wherein the controller controls the driver to open and close the damper, in accordance with a mode corresponding to a selected mode selection button, to bring the ambient temperature within the temperature range corresponding to the selected mode.

18. The apparatus for controlling air flow according to claim 9, further comprising a display that displays at least one of the sensed temperature and the selected mode.

* * * * *